US005724997A

United States Patent [19]

Smith et al.

[11] Patent Number: 5,724,997

[45] Date of Patent: Mar. 10, 1998

[54] DISPOSABLE FLAVORED FILTER FOR CIGARETTES

[75] Inventors: Mickey Lee Smith; Barry Smith Fagg, both of Winston-Salem; John Douglas Weber, Clemmons; David Nicholas Iauco, Winston-Salem, all of N.C.

[73] Assignee: R. J. Reynolds Tobacco Company, Winston-Salem, N.C.

[21] Appl. No.: 576,427

[22] Filed: Dec. 21, 1995

[51] Int. Cl.[6] ..... A24B 5/00

[52] U.S. Cl. ..... 131/331; 131/187; 131/360; 131/359

[58] Field of Search ..... 131/187, 225, 131/364, 331, 334, 359, 200

[56] References Cited

U.S. PATENT DOCUMENTS

| | | | |
|---|---|---|---|
| 2,342,853 | 2/1944 | Furstenberg . | |
| 2,669,995 | 2/1954 | Troy . | |
| 2,796,869 | 6/1957 | Gerard et al. | 131/207 |
| 3,169,535 | 2/1965 | Lassiter et al. | 131/335 |
| 3,347,231 | 10/1967 | Chang . | |
| 3,683,936 | 8/1972 | O'Neil, Jr. . | |
| 4,226,250 | 10/1980 | Ehrenpreis et al. | 131/187 |
| 4,227,540 | 10/1980 | Edison | 131/187 |
| 4,768,526 | 9/1988 | Pryor . | |
| 4,862,905 | 9/1989 | Green, Jr. et al. . | |
| 4,995,407 | 2/1991 | Kossiakoff et al. | 131/359 |
| 5,439,011 | 8/1995 | Schweider | 131/360 |

FOREIGN PATENT DOCUMENTS

| | | | |
|---|---|---|---|
| 434332A2 | 6/1991 | European Pat. Off. | 131/335 |
| 1547656 | 10/1967 | France | 131/331 |
| OS 44 00 266 | 7/1995 | Germany . | |

*Primary Examiner*—V. Millin
*Assistant Examiner*—Charles W. Anderson

[57] ABSTRACT

A disposable flavored filter attachable to the mouth end of a cigarette comprises an insertion end and a mouth end. A first interior portion of the filter, at and adjacent to the insertion end, defines a void space of the filter, while a second interior portion of the filter, at and adjacent to the mouth end, defines one or more segments. In a single-segment embodiment of the invention, flavorant is injected into, or a flavor-containing capsule is inserted into, the single segment. In a two-segment embodiment of the invention, the flavorant is injected into, or the flavor-containing capsule is inserted into, that segment disposed between the void space and the segment at the mouth end of the filter.

14 Claims, 1 Drawing Sheet

DISPOSABLE FLAVORED FILTER FOR CIGARETTES

FIELD OF THE INVENTION

The present invention generally relates to a disposable flavored filter for cigarettes, and more particularly to a disposable flavored filter which is attachable to the mouth end of a cigarette, and which contains any of numerous flavorants, either singularly or in combination.

BACKGROUND OF THE INVENTION

The use of flavorants or aromatic substances as substitutes for cigarettes are known in the art. Such cigarette substitute devices are disclosed, for example, in U.S. Pat. Nos. 2,342,853; 3,347,231; 3,683,936; and 4,995,407.

Moreover, various devices or means for delivering the flavor or aroma to the user of such cigarette substitutes have been developed. For example, see the disclosures of U.S. Pat. Nos. 3,347,231 and 4,995,407.

In addition, it is known in the art of cigarette filter manufacturing to inject a liquid flavorant or to deposit a flavor-emitting pellet in the filter tow as the filter is being formed. In this regard, see U.S. Pat. No. 4,862,905 and U.S. patent application Ser. No. 07/892,082, both assigned to the assignee of the present invention.

However, in the prior art, flavorant or aromatic substances have been introduced into cigarette substitutes and cigarettes during the manufacturing process. Thus, there has been a need in the prior art for the development of a flavor-providing product which is separate and apart from the cigarette product itself, and is in the form of a device which can be attached to the cigarette, at the option of the user.

SUMMARY OF THE INVENTION

The present invention generally relates to a disposable flavored filter for cigarettes, and more particularly to a disposable flavored filter which is attachable to the mouth end of a cigarette, and which contains any of numerous flavorants, either singularly or in combination.

In particular, the disposable flavored filter has an insertion end and a mouth end, and a first interior portion of the filter rod, adjacent to the insertion end, defines a void space of the filter for receiving the mouth end of a cigarette or for receiving the conventional filter located at the mouth end of a cigarette. If desired, the insertion end may be flaired slightly to permit the end of the cigarette to be inserted more easily. The filter rod also has a second interior portion, adjacent to the mouth end of the disposable flavored filter, and the second interior portion defines one or more segments having filter material disposed therein.

In one embodiment, a single segment is disposed at and adjacent to the mouth end of the disposable flavored filter, and at least one flavorant is disposed in the filter material in that segment. In another embodiment, two segments are disposed in the flavored filter, one of those segments being located at and adjacent to the mouth end of the flavored filter and the other of the segments being disposed between the first segment and the void space. In the latter embodiment, at least one flavorant is disposed within the second, or centrally located, segment.

Finally, flavorant can be introduced into the aforementioned segment by garniture or bustle injection, or in the form of microencapsulated flavor pellets, or in the form of a flavor-containing capsule.

Therefore, it is a primary object of the present invention to provide a disposable flavored filter for cigarettes.

It is an additional object of the present invention to provide a disposable flavored filter which is attachable to the mouth end of the cigarette.

It is an additional object of the present invention to provide a disposable flavored filter having a first interior portion defining a void space and a second interior portion defining at least one segment.

It is an additional object of the present invention to provide a disposable flavored filter having a single segment to which flavorant is added.

It is an additional object of the present invention to provide a disposable flavored filter having a plurality of segments, flavorant being added to an interior segment.

It is an additional object of the present invention to provide a disposable flavored filter in which flavorant is added by garniture or bustle injection.

It is an additional object of the present invention to provide a disposable flavored filter in which flavorant is added in the form of microencapsulated flavor pellets.

It is an additional object of the present invention to provide a disposable flavored filter in which a flavor-containing capsule is inserted into a segment of the filter.

The above and other objects, and the nature of the invention, will be more clearly understood by reference to the following detailed description, the appended claims, and the accompanying drawings.

DETAILED DESCRIPTION OF THE INVENTION

The invention will now be described in more detail with reference to the various figures of the drawings.

Figure 1:
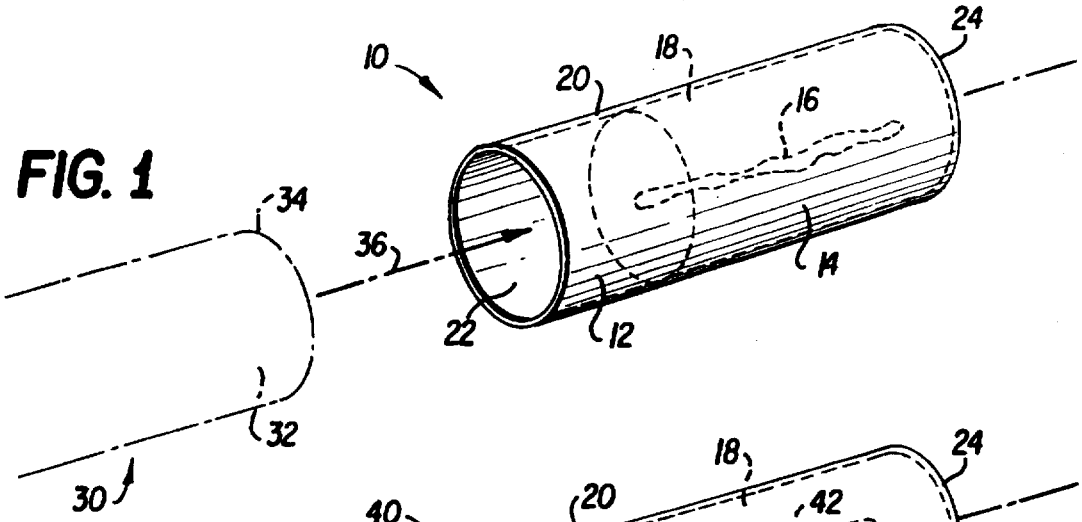
FIG. 1 is a perspective view of the disposable flavored filter having a single segment to which flavorant is added.

FIG. 1 is a perspective view of the disposable flavored filter having a single segment to which flavorant is added. As seen therein, the disposable flavored filter 10 is employed with, and is attachable to, a cigarette 30, and more particularly to a filter 32 disposed at the mouth end 34 of the cigarette 30.

As further seen in FIG. 1, the disposable flavored filter 10 comprises a void space 12 defined by an interior portion of the filter 10 located at and adjacent to an insertion end 22 of the filter 10. The filter 10 also includes a single segment 14 occupying the remainder of the interior portion of the filter 10 at and adjacent to the mouth end 24 of the filter 10.

The segment 14 is composed of a filter material, and any of numerous fibrous and other materials can be used as the filter material for the segment 14. Desirable materials include cellulose acetate, polypropylene, and paper. Cellulose acetate is inexpensive and, since it is a material commonly used in conventional cigarettes, it has the advantage of being familiar to smokers. In addition, cellulose acetate is easy to manufacture. Polypropylene has the advantage, over cellulose acetate, of providing greater firmness and durability of the filter 10, and also releases flavors in a more efficient manner. Finally, a gathered paper has the advantage of a lower pressure drop through the filter 10.

Segment 14 is wrapped in plug wrap 18, and is then wrapped again inside tipping-like paper 20. Paper 20 extends past the end of segment 14 at insertion end 22 of the filter 10 so as to form a hollow portion defining void space 12. The filter 10, at insertion end 22, has an inside diameter of sufficient size to receive the mouth end 34 of cigarette 30 along the longitudinal axis 36. If desired, the insertion end 22 may be flared slightly to permit easy insertion of the mouth end 34 of the cigarette 30.

As an example, the embodiment of FIG. 1 can be implemented in the form of a filter 10 having a length of approximately 28 mm and a circumference of approximately 25.90 mm. The 28 mm length consists of a void space 12 of approximately 10 mm in length and a single segment 14 of filter material having a length of approximately 18 mm.

As previously mentioned, in accordance with the present invention, flavorant 16 is added to the segment 14 by garniture or bustle injection, or in the form of microencapsulated flavor pellets inserted into the filter 10 so as to increase the shelf life of the flavors. Alternatively, flavor can be printed onto a paper substrate, if the latter is employed as filter material for the segment 14.

Figure 2:
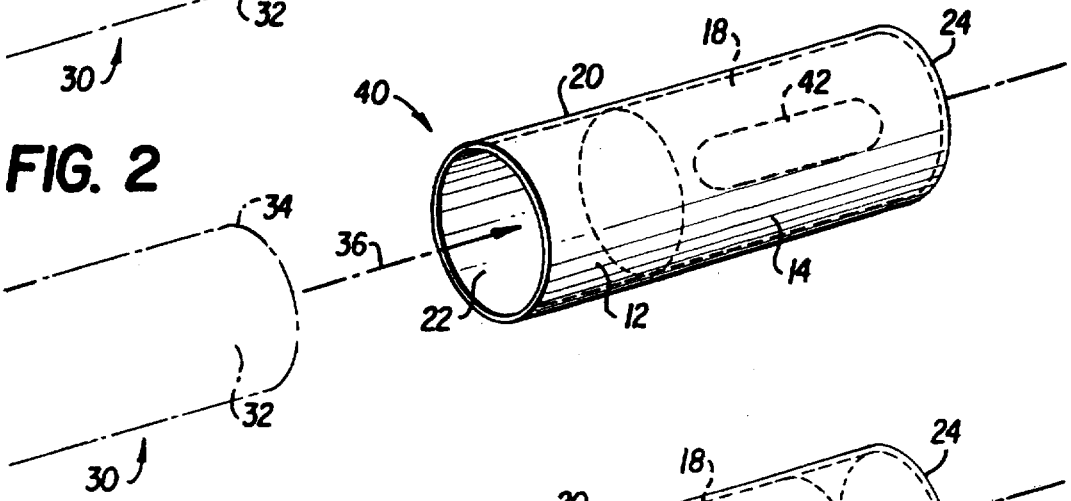
FIG. 2 is a perspective view of a disposable flavored filter having a single segment, into which a flavor-containing capsule is inserted.

FIG. 2 is a perspective view of a disposable flavored filter having a single segment, into which a flavor-containing capsule is inserted. The overall structure of the disposable flavored filter 40 of FIG. 2 is basically the same as the structure of disposable flavored filter 10 of FIG. 1, and thus identical reference numerals have been used where appropriate.

In contrast to the filter 10 of FIG. 1, the filter 40 of FIG. 2 is provided with flavorant in the form of one or more flavor-containing capsules 42. Preferably, capsules 42 are frangible in nature so that they will burst upon squeezing by the user. Use of the capsules 42 greatly increases the shelf life of the filter 10, and also permits the consumer to control the time at which the flavor is to be released.

Figure 3:
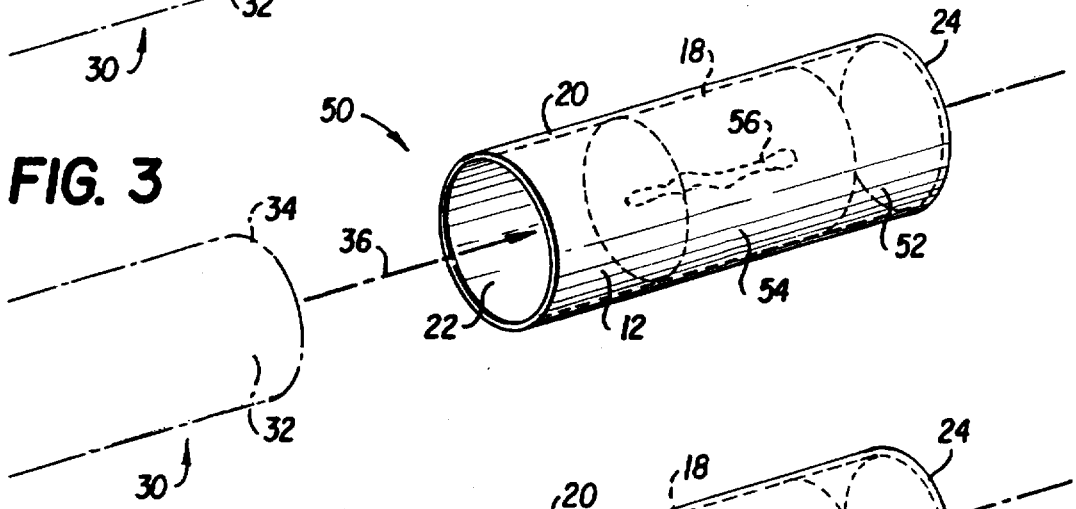
FIG. 3 is a perspective view of a disposable flavored filter having two segments, flavorant being added to an interior segment.

FIG. 3 is a perspective view of a disposable flavored filter having two segments, flavorant being added to an interior segment. As seen therein, the disposable flavored filter 50 comprises a void space 12 located at insertion end 22 of filter 50 and a segment 52 located at the mouth end 24 of the filter 50, with an additional segment 54 being located therebetween. As was the case in the previous embodiments, the segments 52 and 54 are enclosed within plug wrap 18, and the segments 52 and 54 are then further enclosed within tipping-like paper 20. As was also the case in the embodiments described above, tipping-like paper 20 extends past the end of segment 54 toward the insertion end 22 so as to form void space 12.

Segment 52, is, preferably, cellulose acetate tow used as a mouth end piece at mouth end 24, while segment 54 is, preferably, a filter material consisting of a gathered paper.

In accordance with the present invention, the filter material of segment 54 is injected with flavorant 56 by means of garniture or bustle injection, or by means of microencapsulated flavor pellets applied thereto.

Figure 4:
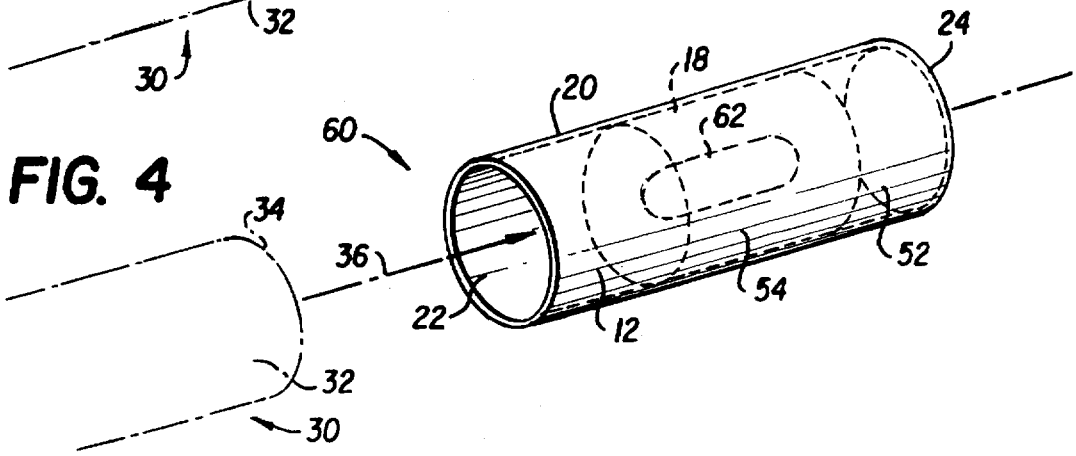
FIG. 4 is a perspective view of a disposable flavored filter having two segments, a flavor-containing capsule being inserted into an interior segment.

FIG. 4 is a perspective view of a disposable flavored filter having two segments, a flavor-containing capsule being inserted into an interior segment. The embodiment disclosed in FIG. 4 basically coincides with the embodiment disclosed in FIG. 3, and thus identical reference numerals have been used where appropriate. However, in the embodiment of FIG. 4, as contrasted with the embodiment of FIG. 3, one or more flavor-containing capsules 62 are disposed in the segment 54. Such flavor-containing capsules 62 are, preferably, frangible in nature so that they will burst upon squeezing by the user. The capsules 62 greatly increase the shelf life of the product, and also permit the consumer to control the time at which flavorant is to be released.

By way of example, the embodiments of FIGS. 3 and 4 can be implemented by a filter 10 having a length of approximately 28 mm. The segment arrangement of the embodiments of FIGS. 3 and 4 would be such that the void space 12 measures approximately 10 mm in length, the segment 54 is approximately 12 mm in length, and the segment 52 is approximately 6 mm in length.

As an alternative example, the filters 50 and 60 of FIGS. 3 and 4, respectively, can be implemented as filters having a length of approximately 22 mm and a circumference of approximately 25.90 mm, with the void space 12 measuring 10 mm in length, segment 54 measuring approximately 6 mm in length, and segment 52 measuring approximately 6 mm in length.

It should be noted that, in each of the embodiments of FIGS. 1–4 discussed above, the plug wrap 18 employed is, preferably, a non-porous plug wrap, such as 646 plug wrap made by Wattens Papiers of Wattens, Austria. The flavorants employed in the above embodiments can be of numerous types; for example, menthol, peppermint, chocolate, coffee, cinnamon, tobacco, spearmint, wintergreen, clove, rum, and the like can be employed.

The above-described embodiments of the invention would be used by smokers as follows. The filters 10, 40, 50 or 60 of FIGS. 1–4, respectively, would be attached to the mouth end 34 of cigarette 30, that is, to the filter 32 of cigarette 30 by inserting the mouth end 34 (filter 32) into the insertion end 22 so that the filter 32 comes to rest in void space 12 of the filters 10, 40, 50 or 60. The user will then light the cigarette 30 in the normal manner. The flavor of flavorants 16 and 56 of FIGS. 1 and 3 will be provided to the consumer without any further action on the part of the consumer. Alternatively, if the embodiments of FIGS. 2 and 4 are employed, the flavor-containing capsules 42 and 62 must be squeezed by the user in order to release the flavor at which time the flavor will be provided to the user. When finished with the cigarette 30 and disposable flavored filter 10, they will be disposed by the consumer in a normal manner.

While preferred forms and arrangements have been shown in illustrating the invention, it is to be understood that various changes and modifications can be made without departing from the spirit and scope of this disclosure.

What is claimed is:

1. A disposable flavored filter adapted to be attached to a cigarette by a user, said filter having a mouth end and an insertion end, at least one filter segment located at said mouth end, said filter segment comprising a smoke filtration material, at least one flavorant disposed in said filter material, said insertion end having a hollow portion defining a cylindrical void space having an axial length of about 10 mm for slidably receiving about 10 mm of one end of a cigarette axially inserted therein by the user, said filter having at least one paper wrapping wrapped about said one filter segment and forming said void space at the insertion end of the filter whereby a cigarette to be smoked by the user is axially and slidably inserted into said void space by the user such that when the cigarette is fully inserted into the void space it is fully extended in the smoking position and is removably retained in such space.

2. The filter of claim 1, wherein said at least one flavorant comprises an injected flavorant.

3. The filter of claim 1, wherein said at least one flavorant comprises microencapsulated pellets.

4. The filter of claim 1, wherein said filter material comprises a paper substrate and said at least one flavorant comprises a flavorant printed on the paper substrate.

5. The filter of claim 1, wherein said at least one flavorant is contained within a capsule disposed in said at least one segment.

6. The disposable filter of claim 1, wherein said filter material comprises cellulose acetate and including a plug wrap wrapped about said cellulose acetate, said one paper wrapping comprising a tipping paper wrapped about said plug wrap.

7. The disposable filter of claim 1, wherein said filter material comprises gathered paper and including a plug wrap wrapped about said gathered paper, said one paper wrapping comprising a tipping paper wrapped about said plug wrap.

8. The disposable filter of claim 1, wherein said filter material comprises polypropylene and including a plug wrap wrapped about said polypropylene, said one paper wrapping comprising a tipping paper wrapped about said plug wrap.

9. The disposable filter of claim 1, wherein said paper wrapping is cylindrically shaped and flared to permit easy insertion of said one end of said cigarette axially into the void space.

10. The disposable filter of claim 1, including two filter segments, said flavorant being disposed in a first one of said segments, a second one of said segments being disposed at said mouth end and said first segment being disposed adjacent said void space at said insertion end.

11. A disposable filter adapted to be attached to a cigarette by a user, said filter having a mouth end and an insertion end, at least one filter segment located at said mouth end, said filter segment comprising a smoke filtration material, said insertion end having a hollow portion defining a cylindrical void space having an axial length of about 10 mm for slidably receiving about 10 mm of one end of a cigarette axially inserted therein by the user, said filter having at least one paper wrapping wrapped about said one filter segment and forming said void space at the insertion end of the filter whereby a cigarette to be smoked by the user such that when the cigarette is fully inserted into the void space it is fully extended in the smoking position and is removably retained in such space.

12. The disposable filter of claim 11, including at least one flavorant disposed in said filter material.

13. The disposable filter of claim 12, including two filter segments, said flavorant being disposed in a first one of said segments, a second one of said segments being disposed at said mouth end and said first segment being disposed adjacent said void space at said insertion end.

14. The disposable filter of claim 11, wherein said paper wrapping is cylindrically shaped and flared to permit easy insertion of said one end of said cigarette axially into the void space.

* * * * *